US008366507B2

(12) United States Patent
Chen

(10) Patent No.: US 8,366,507 B2
(45) Date of Patent: Feb. 5, 2013

(54) BUILDING TOY BLOCK SET

(76) Inventor: Ying-Jen Chen, Taoyuan City (TW)

( * ) Notice: Subject to any disclaimer, the term of this patent is extended or adjusted under 35 U.S.C. 154(b) by 388 days.

(21) Appl. No.: 12/839,379

(22) Filed: Jul. 19, 2010

(65) Prior Publication Data

US 2012/0015583 A1 Jan. 19, 2012

(51) Int. Cl.
*A63H 33/08* (2006.01)
*A63H 33/00* (2006.01)

(52) U.S. Cl. ..... 446/108; 446/111; 446/115; 446/122

(58) Field of Classification Search ..... 446/85, 446/104, 105, 108, 111, 115, 116, 122, 476, 446/478, 482, 487; 52/80.2, 81.1, 591.1, 52/592.1; 403/1, 24, 364, 339, 340
See application file for complete search history.

(56) References Cited

U.S. PATENT DOCUMENTS 4,792,319 A * 12/1988 Svagerko ..... 446/104
5,545,070 A * 8/1996 Liu ..... 446/104
5,823,843 A * 10/1998 Pohlman ..... 446/120
5,921,781 A * 7/1999 Shaw ..... 434/298
6,464,553 B2 * 10/2002 Huang ..... 446/104
7,192,329 B2 * 3/2007 Lee ..... 446/116
7,438,623 B2 * 10/2008 Lin ..... 446/108
7,985,115 B2 * 7/2011 McCloskey ..... 446/85

* cited by examiner

*Primary Examiner* — Kien Nguyen

(57) ABSTRACT

A building toy block set consisting of base blocks and connection blocks is disclosed. Each base block has a connection notch located on each of multiple peripheral sides thereof and extending in direction toward the center thereof, and two pivot holes arranged at two opposite lateral sides of each connection notch. Each connection block has two pivot pins respectively located on two first opposing sides thereof and respectively pivotally connectable to the pivot holes at two opposite lateral sides of one connection notch of one base block, and a plug rod and a plughole respectively located on two second opposing sides thereof in such a manner that the plug rod of one connection block can be press-fitted into the plughole of another connection block.

5 Claims, 6 Drawing Sheets

BUILDING TOY BLOCK SET

BACKGROUND OF THE INVENTION

1. Field of the Invention

The present invention relates to building toy blocks and more particularly, to a building toy block set formed of toy blocks and connection blocks for building up any of a variety of combinations.

2. Description of the Related Art

In recent years, many different intelligent combination toys have been created and have appeared on the market. These intelligent combination toys are greatly appreciated by people for the advantage of helping children to develop creative giftedness and thinking skills. Among intelligent combination toys, building toy block sets are mostly appreciated by parents.

A regular building toy block has protruding ribs and recessed holes. By means of press-fitting one protruding rib of one toy block into one recessed hole of another toy block, multiple toy blocks can be connected together in horizontal or vertical direction to build up a three-dimensional structure. However, because these toy blocks can simply be connected together in a horizontal or vertical direction, the configuration of the constructed combination is limited, affecting user interest.

SUMMARY OF THE INVENTION

The present invention has been accomplished under the circumstances in view. It is one object of the present invention to provide a building toy block set consisting of base blocks and connection blocks, wherein the connection blocks are pivotally connectable to the periphery of the base blocks for enabling the base blocks to be fastened together to build up any of a variety of three-dimensional structures.

To achieve this and other objects of the present invention, a building toy block set comprises a plurality of base blocks and a plurality of connection blocks. Each base block has a connection notch located on each of multiple peripheral sides thereof and extending in direction toward the center thereof, and two pivot holes arranged at two opposite lateral sides of each connection notch. Each connection block has two pivot pins respectively located on two first opposing sides thereof and respectively pivotally connectable to the pivot holes at two opposite lateral sides of one connection notch of one base block, and a plug rod and a plughole respectively located on two second opposing sides thereof in such a manner that the plug rod of one connection block can be press-fitted into the plughole of another connection block.

DETAILED DESCRIPTION OF THE PREFERRED EMBODIMENT

Figure 1:
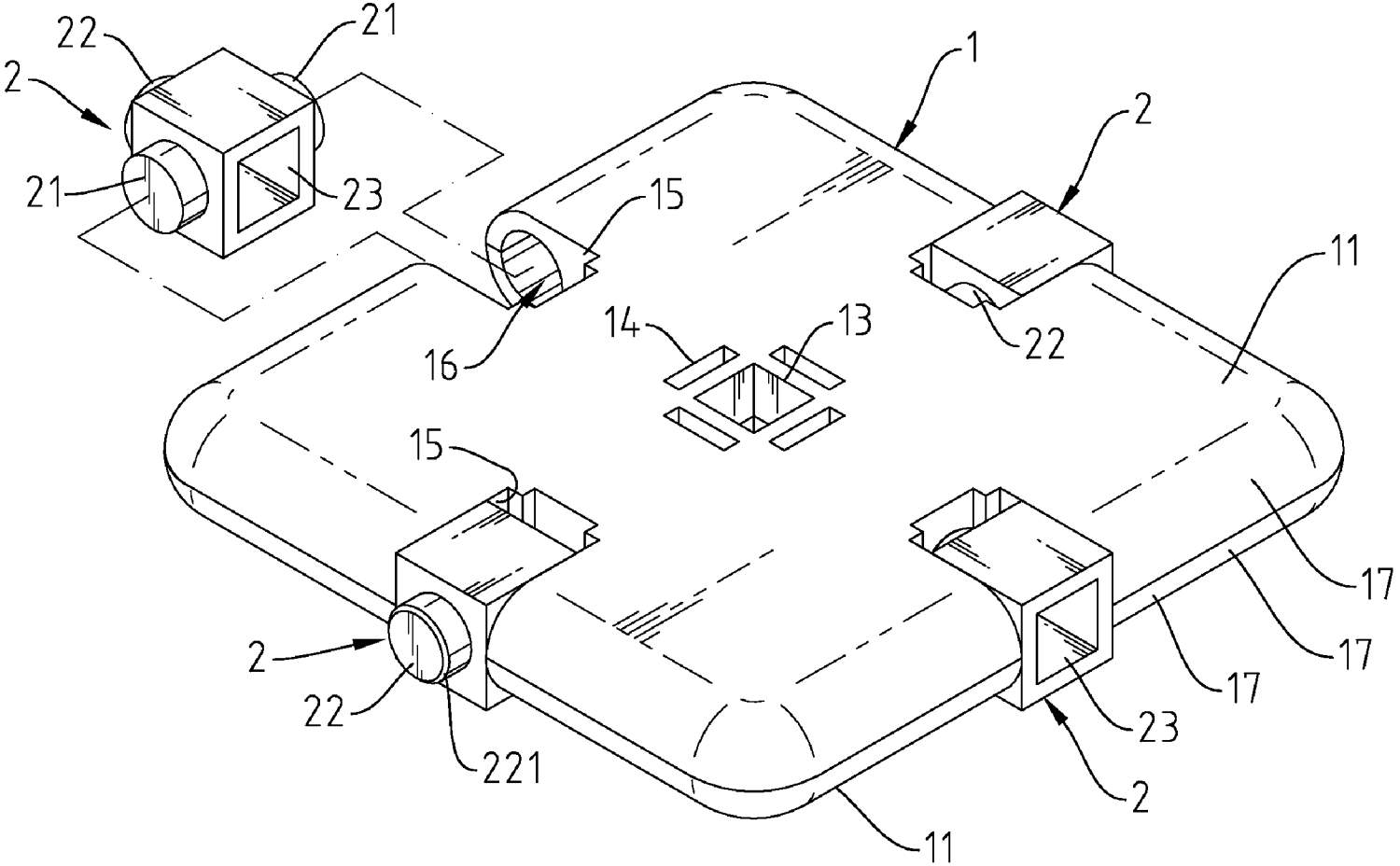
FIG. 1 is an elevational view of one base block and one connection block of a building toy block set in accordance with the present invention.
Figure 2:
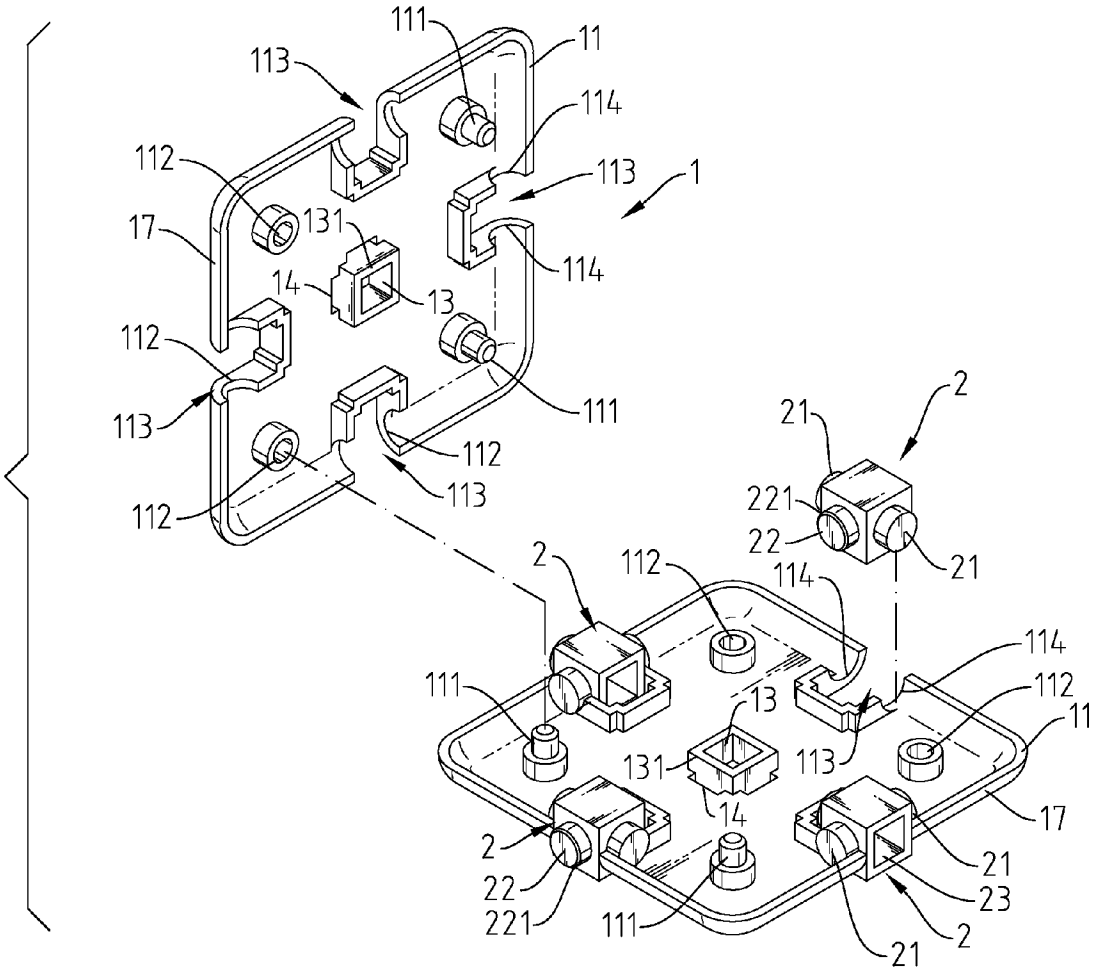
FIG. 2 is an exploded view of the base block for building toy block set in accordance with the present invention.

Referring to FIGS. 1 and 2, a building toy block set in accordance with the present invention is shown comprising a plurality of base blocks 1, a plurality of connection blocks 2.

Each base block 1 is formed of two symmetrical half shells 11. Each half shell 11 has a plurality of studs 111 and sockets 112 located on the bottom wall thereof, a connection hole 13 cut through the top and bottom walls thereof at the center, a reinforcing rib 131 protruded from the bottom wall around the connection hole 13, four crevices 14 cut through the top and bottom walls and spaced from one another at four sides around the connection hole 13, a side notch 113 located on the middle of each of multiple peripheral sides thereof and extending in direction toward the center thereof, two coupling notches 114 respectively located on two opposing sides of each of the side notches 113, and a chamfered round-arched surface 17 located on each of the corners thereof. When the two symmetrical half shells 11 are fastened together, one side notch 113 of one of the two symmetrical half shells 11 form with the associating side notch 113 of the other one of the two symmetrical half shells 11 a connection notch 15, and one coupling notch 114 of one of the two symmetrical half shells 11 form with the associating coupling notch 114 of the other one of the two symmetrical half shells 11 a pivot hole 16.

Each connection block 2 has two pivot pins 21 respectively located on two first opposing sides thereof, a plug rod 22 and a plughole 23 respectively located on two second opposing sides thereof. The plug rod 22 has a tapered guide surface 221 at the distal end thereof. Further, the outer diameter of the plug rod 22 is slightly greater than the inner diameter of the plughole 23.

During connection between one base block 1 and one or a number of the connection blocks 2, put each connection block 2 in one of the side notches 113 of one half shell 11 to rest the pivot pins 21 in the associating two coupling notches 114, and then attach the other half shell 11 to have the two half shells 11 be fastened together by forcing the studs 111 of one half shell 11 into the sockets 112 of the other half shell 11. At this time, the side notches 113 of the half shells 11 form respective connection notches 15; the coupling notches 114 of the half shells 11 form respective pivot holes 16; the connection blocks 2 are respectively pivotally connected to the respective connection notches 15.

Figure 3:
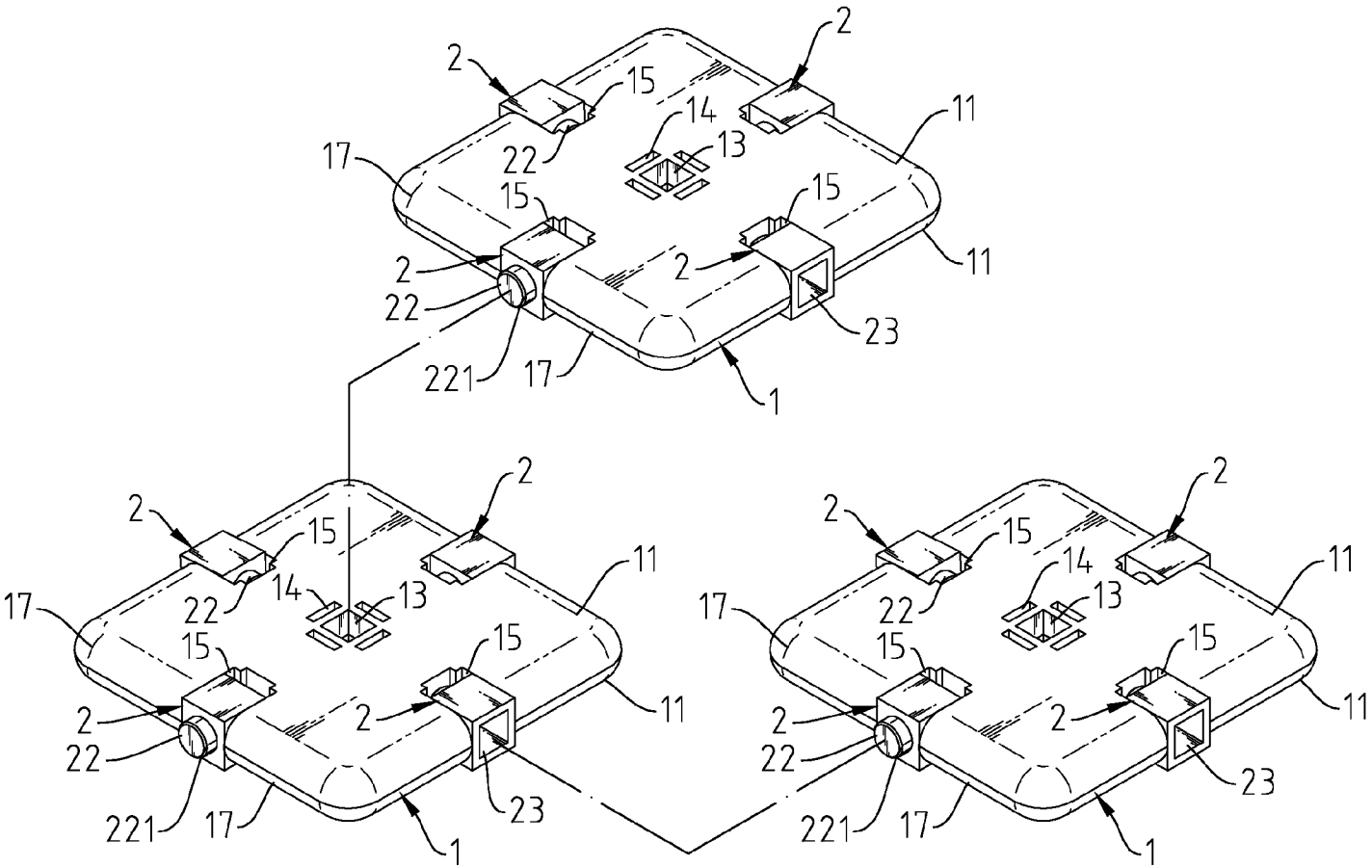
FIG. 3 illustrates connection examples among base blocks of the building toy block set in accordance with the present invention.
Figure 4:
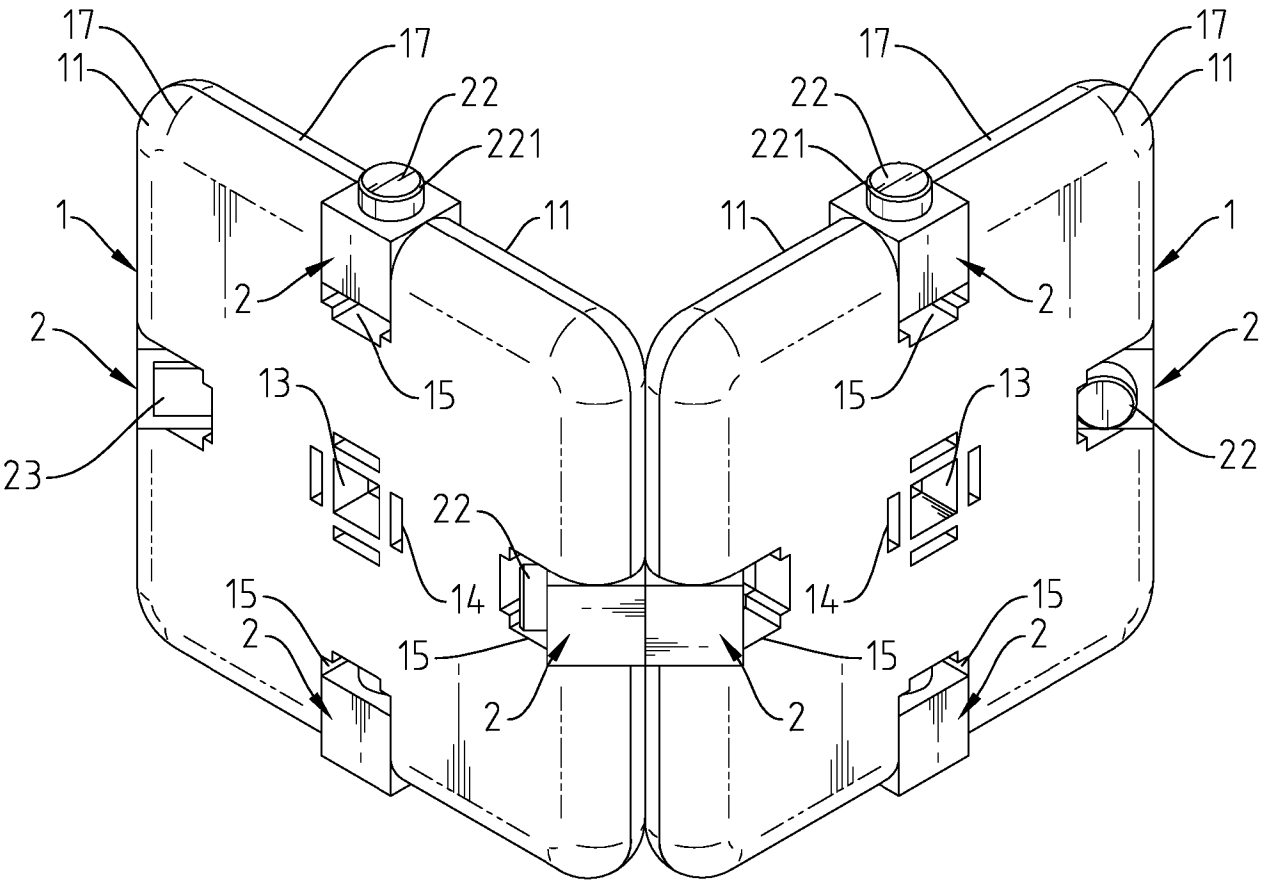
FIG. 4 shows two base blocks connected together subject to a predetermined included angle in accordance with the present invention.

Referring to FIGS. 3 and 4, when connecting two base blocks 1 together, insert the plug rod 22 of one connection block 2 at one base block 1 into the plughole 23 of one connection block 2 at the other base block 1. Because the outer diameter of the plug rod 22 is slightly greater than the inner diameter of the plughole 23, the plug rod 22 of one connection block 2 at one base block 1 can be tightly press-fitted into the plughole 23 of one connection block 2 at the other base block 1. Further, by means of the tapered guide surface 221, the plug rod 22 of one connection block 2 at one base block 1 can be conveniently press-fitted into the plughole 23 of one connection block 2 at the other base block 1 to connect the two base blocks 1 together. After connection of the two base blocks 1, each connected connection block 2 can be biased relative to the connected base blocks 1 to any desired connection angle. Thus, the two connected base blocks 1 can be biased relative to each other to adjust the contained angle therebetween. The design of the chamfered round-arched surface 17 at each corner of each half shell 11 enables the two connected base blocks 1 to be biased relative to each other without interference.

Further, the plug rod 22 of each connection block 2 can also be tightly press-fitted into the connection hole 13 of either half shell 11 of one base block 1. Further, because each half shell 11 of each base block 1 has crevices 14 cut through the top and bottom walls and spaced from one another at four sides around the connection hole 13 thereof, the connection hole 13 can be expanded upon insertion of the plug rod 22 of one connection block 2 to connect two base blocks 1 together.

Figure 5:
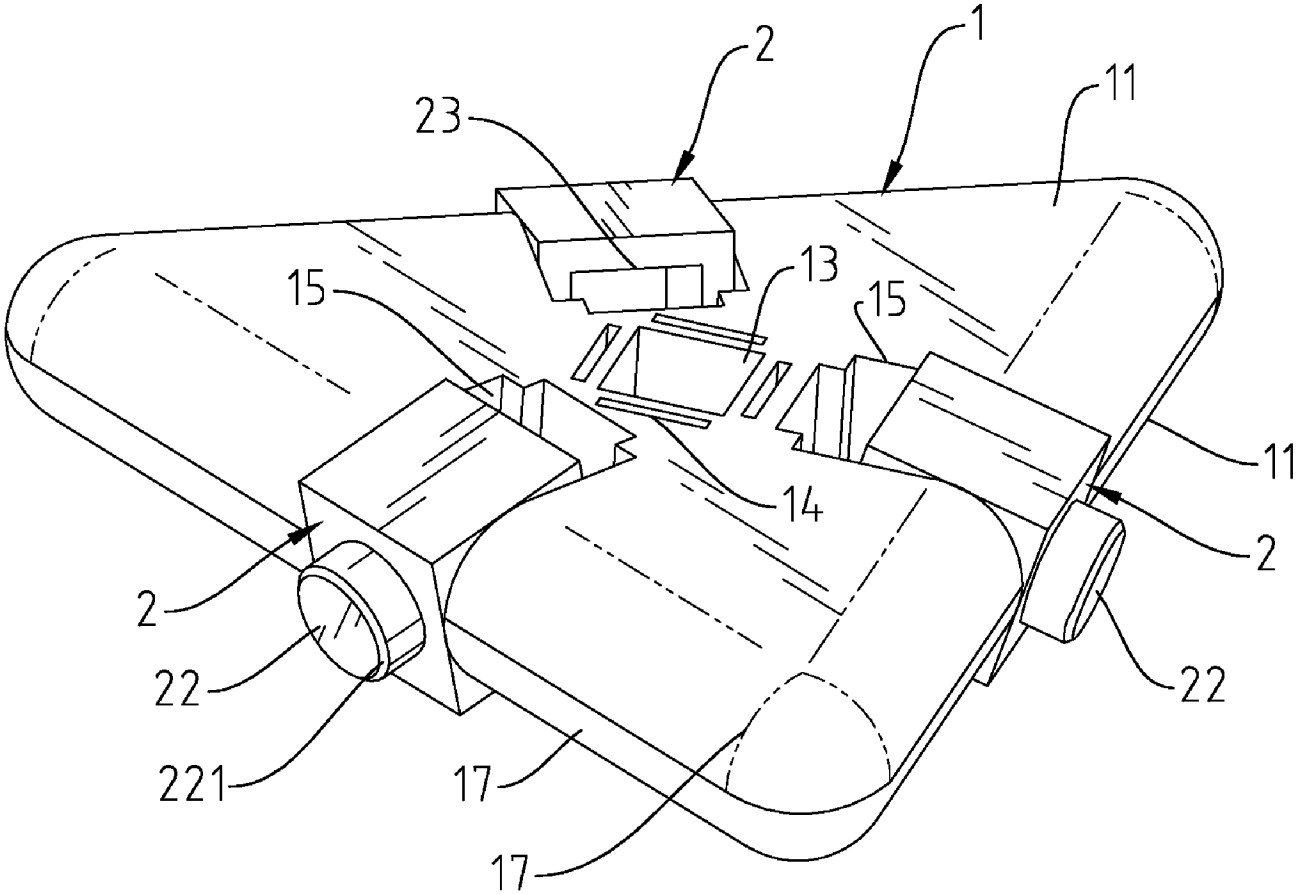
FIG. 5 is an elevational view of an alternate form of the base block for building toy block set in accordance with the present invention.
Figure 6:
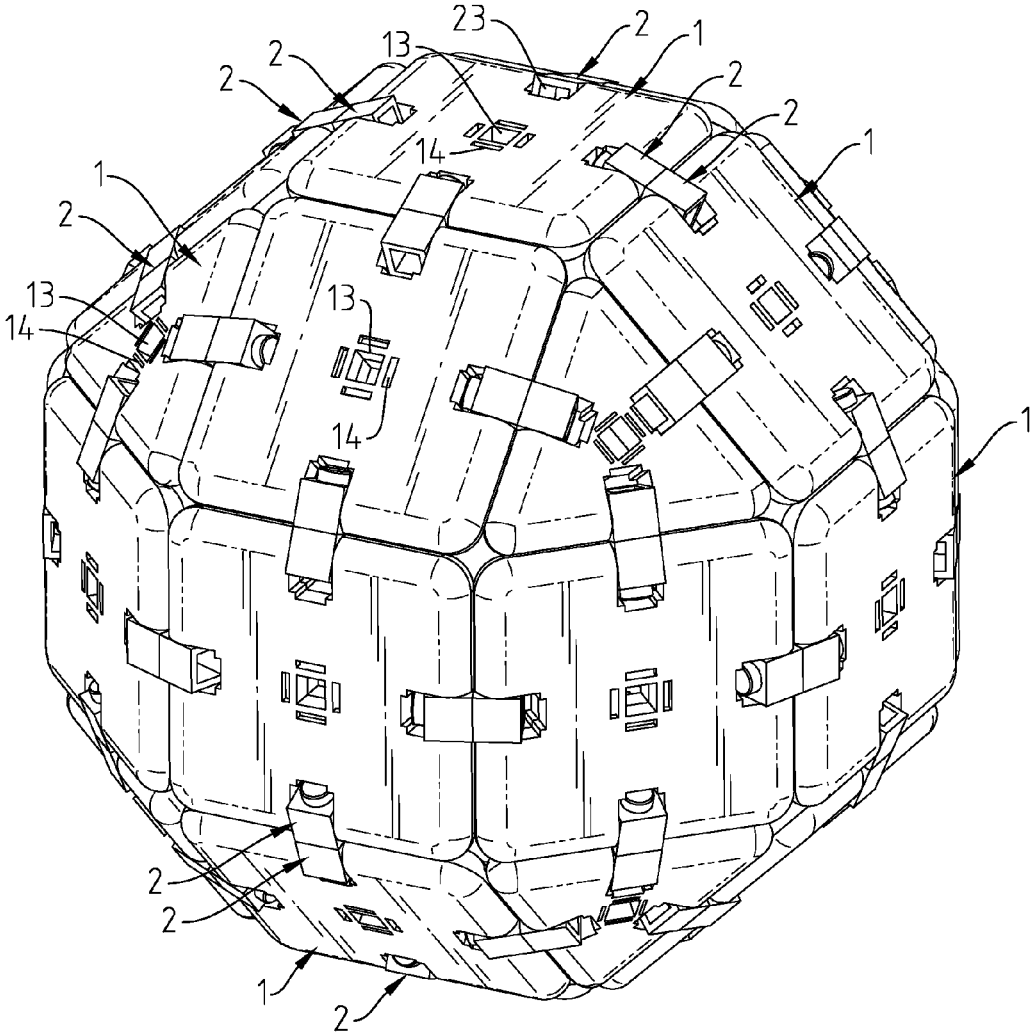
FIG. 6 illustrates a spherical toy block assembly according to an application example of the present invention.

Referring to FIGS. 5 and 6 and FIG. 4 again, because the design of the chamfered round-arched surface 17 at each corner of each half shell 11 enables each two connected base blocks 1 to be biased relative to each other without interference, there is no any connection angle limitation, and therefore the base blocks 1 and the connection blocks 2 are be assembled together to build up any of a variety of three-dimensional structures. Further, the connection blocks 2 can be prepared in a substantially rectangular shape (see FIGS. 1~4) or triangular shape (see FIG. 5).

Therefore, the invention eliminates the drawbacks of the conventional techniques and enhances functioning subject to the technical feature that each connection block 2 has two pivot pins 21 respectively located on two first opposing sides thereof, a plug rod 22 and a plughole 23 respectively located on two second opposing sides thereof, and is pivotally connectable to either connection notch 15 of each base block 1 and adjustable to any desired angle. Thus, by means of connecting the plug rod 22 of one connection block 2 at one base block 1 to the plughole 23 of another connection block 2 at another base block 1, multiple base blocks 1 and connection blocks 2 can be connected together to build up any of a variety of three dimensional structures.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A building toy block set, comprising a plurality of base blocks and a plurality of connection blocks adapted for connecting said base blocks, wherein each said base block comprises a connection notch located on each of multiple peripheral sides thereof and extending in direction toward the center thereof and two pivot holes arranged at two opposite lateral sides of said connection notch; each said connection block comprises two pivot pins respectively located on two first opposing sides thereof and respectively pivotally connectable to the pivot holes at two opposite lateral sides of one connection notch of one said base block, and a plug rod and a plughole respectively located on two second opposing sides thereof, said plug rod having an outer diameter slightly greater than the inner diameter of said plughole.

2. The building toy block set as claimed in claim 1, wherein each said base block is formed of two symmetrical half shells, each said half shell comprising a plurality of studs and sockets located on a bottom wall thereof for mounting.

3. The building toy block set as claimed in claim 1, wherein each said base block is formed of two symmetrical half shells, each said half shell comprising a connection hole cut through top and bottom walls thereof at the center for the connection of the plug rod of one said connection block and a reinforcing rib protruded from the bottom wall thereof around said connection hole.

4. The building toy block set as claimed in claim 1, wherein each said base block is formed of two symmetrical half shells, each said half shell comprising a side notch located on the middle of each of multiple peripheral sides thereof and extending in direction toward the center thereof, one side notch of one said half shell being formed with one respective side notch of the other said half shell one said connection notch when said two symmetrical half shells are fastened together.

5. The building toy block set as claimed in claim 4, wherein each said half shell comprises two coupling notches respectively located on two opposing sides of each of the side notches thereof such that when said two symmetrical half shells are fastened together, one coupling notch of one said half shell form with the associating coupling notch of the other half shell one said pivot hole.

* * * * *